US012084878B2

(12) United States Patent
Zhou

(10) Patent No.: US 12,084,878 B2
(45) Date of Patent: Sep. 10, 2024

(54) CENTRAL LOCKING STRUCTURE OF FOLDING TENT

(71) Applicant: Wuyi Shenhua Industry & Trade Co., Ltd, Wuyi (CN)

(72) Inventor: Xuzhi Zhou, Wuyi (CN)

(73) Assignee: Wuyi Shenhua Industry & Trade Co., Ltd, Wuyi (CN)

( * ) Notice: Subject to any disclaimer, the term of this patent is extended or adjusted under 35 U.S.C. 154(b) by 149 days.

(21) Appl. No.: 17/969,586

(22) Filed: Oct. 19, 2022

(65) Prior Publication Data

US 2024/0068266 A1 Feb. 29, 2024

(30) Foreign Application Priority Data

Aug. 31, 2022 (CN) ..... 202211066153.7
Aug. 31, 2022 (CN) ..... 202222307442.3

(51) Int. Cl.
*E04H 15/48* (2006.01)

(52) U.S. Cl.
CPC ..... *E04H 15/48* (2013.01)

(58) Field of Classification Search
CPC ..... E04H 15/36; E04H 15/48; E04H 15/50
See application file for complete search history.

(56) References Cited

U.S. PATENT DOCUMENTS

| | | | | |
|---|---|---|---|---|
| 8,499,778 | B2 * | 8/2013 | Ha | E04H 15/44 135/159 |
| 10,060,153 | B2 * | 8/2018 | Song | E04H 15/34 |
| 10,107,005 | B2 * | 10/2018 | Song | E04H 15/44 |
| 10,669,738 | B2 * | 6/2020 | Yang | E04H 15/50 |
| 10,822,829 | B1 * | 11/2020 | Lu | E04H 15/32 |
| 10,941,585 | B2 * | 3/2021 | Sun | E04H 15/50 |
| 10,982,464 | B2 * | 4/2021 | Ying | E04H 15/44 |
| 11,002,036 | B1 * | 5/2021 | Zhang | E04H 15/48 |
| 11,085,201 | B2 * | 8/2021 | Sun | E04H 15/50 |
| 11,199,023 | B2 * | 12/2021 | Sun | E04H 15/50 |
| 11,306,511 | B2 * | 4/2022 | Sun | E04H 15/50 |
| 11,821,228 | B2 * | 11/2023 | Sun | E04H 15/60 |
| 2022/0064982 | A1 * | 3/2022 | Chen | E04H 15/60 |
| 2023/0064601 | A1 * | 3/2023 | Liu | E04H 15/50 |

* cited by examiner

*Primary Examiner* — Noah Chandler Hawk
(74) *Attorney, Agent, or Firm* — Bayramoglu Law Offices LLC

(57) ABSTRACT

A central locking structure of a folding tent includes a first pole hub, a second pole hub, a connecting rod, a locking assembly, and a drive assembly. The bottom of the first pole hub is provided with the connecting rod, and the top of the second pole hub is provided with an insertion port into which a lower end of the connecting rod is inserted. The second pole hub is provided with a locking chamber communicating with the insertion port. The locking assembly is provided in the locking chamber and is configured to fix the lower end of the connecting rod. The drive assembly is configured to drive the locking assembly to lock or unlock the lower end of the connecting rod. The bottom of the first pole hub is provided with the connecting rod.

9 Claims, 5 Drawing Sheets

CENTRAL LOCKING STRUCTURE OF FOLDING TENT

CROSS REFERENCE TO THE RELATED APPLICATIONS

This application is based upon and claims priority to Chinese Patent Application No. 202211066153.7, filed on Aug. 31, 2022, and Chinese Patent Application No. 202222307442.3, filed on Aug. 31, 2022, the entire contents of which are incorporated herein by reference.

TECHNICAL FIELD

The present disclosure relates to the technical field of tents and in particular to a central locking structure of a folding tent.

BACKGROUND

Folding tents are popular and have become one of the must-have leisure items for outdoor use because they are easy to assemble, carry, and fold. The folding tent mainly includes a tent fabric and a tent frame for supporting the tent fabric. The tent frame of the existing folding tent usually includes an upper pole group, a lower pole group, and a central locking structure. The central locking structure includes a first pole hub and a second pole hub for mounting the upper pole group and the lower pole group. When the first pole hub and the second pole hub are fixed, the upper pole group and the lower pole group are combined to form the tent frame for supporting the tent fabric.

The existing central locking structure usually uses bolts to lock and fixedly connect the first pole hub and the second pole hub. However, this method is time-consuming and labor-intensive in assembly and disassembly and involves many separable parts, resulting in a complex structure and easy loss of parts.

SUMMARY

An objective of the present disclosure is to provide a central locking structure of a folding tent to solve the above problems.

To achieve the above objective, the present disclosure adopts the following technical solution:

The central locking structure of a folding tent includes a first pole hub, a second pole hub, a connecting rod, a locking assembly, and a drive assembly. The bottom of the first pole hub is provided with the connecting rod, and the top of the second pole hub is provided with an insertion port into which a lower end of the connecting rod is inserted. The second pole hub is provided with a locking chamber communicating with the insertion port. The locking assembly is provided in the locking chamber and is configured to fix the lower end of the connecting rod. The drive assembly is configured to drive the locking assembly to lock or unlock the lower end of the connecting rod.

Preferably, the locking assembly includes rollers and a plurality of locking teeth circumferentially arranged on the outer wall of each of the rollers. The side wall of the connecting rod is axially provided with a plurality of locking grooves which are matched with the locking teeth. The drive shaft is provided on two sides of each of the rollers. The inner wall of the locking chamber is provided with first oblong holes for the drive shaft to move. The drive assembly drives the drive shaft to move in the first oblong holes, such that the locking teeth on the outer wall of each of the rollers are locked into or disengaged from the locking grooves.

Preferably, the first oblong holes are inclined toward the connecting rod.

Preferably, the drive assembly includes a sliding sleeve and a spring member. The upper and lower ends of the second pole hub are respectively provided with an upper limiting piece and a lower limiting piece. The sliding sleeve is slidably sleeved on the outer wall of the second pole hub and is located between the upper limiting piece and the lower limiting piece. The sliding sleeve is elastically connected to the lower limiting piece through the spring member. The outer wall of the sliding sleeve is provided with second oblong holes. The ends of the drive shaft are movably inserted into the second oblong holes through the first oblong holes. The second oblong holes are inclined in a direction that is opposite to the direction in which the first oblong holes are inclined.

Preferably, the bottom end of the sliding sleeve and the top end of the lower limiting piece are respectively provided with an upper mounting groove and a lower mounting groove. The upper and lower ends of the spring member are respectively inserted into the upper mounting groove and the lower mounting groove, and the inner diameters of the upper mounting groove and the lower mounting groove are adapted to correspond to an outer diameter of a spring of the spring member.

Preferably, limiting grooves are provided in the locking chamber and located above the first oblong holes. The limiting grooves are configured to limit the left and right positions of the locking assembly in cooperation with the locking grooves when the locking teeth are locked into the locking grooves.

Preferably, the bottom end of the connecting rod extends inward to form a push head.

Preferably, there are two rollers provided on two sides of the connecting rod respectively.

Preferably, the inner diameter of the insertion port is larger than the outer diameter of the connecting rod. A lower end of the insertion port extends inward to form a limiting port. The inner diameter of the limiting port is adapted to correspond to the outer diameter of the connecting rod.

Preferably, the first pole hub includes a first pole hub body and a plurality of first hinge bases that are circumferentially arranged on the bottom of the first pole hub body. Each of the plurality of first hinge bases is hinged to an upper pole. The second pole hub includes a second pole hub body and a plurality of second hinge bases that are circumferentially arranged on the top of the second pole hub body and correspond to the first hinge bases. The second hinge bases are each hinged to one end of a lower pole, the other end of which is rotatably connected to the upper pole.

With the above technical solution, the present disclosure has the following advantages over the prior art mentioned in the Background section:

1. In the present disclosure, the bottom of the first pole hub is provided with the connecting rod, and the top of the second pole hub is provided with the locking assembly for fixing the lower end of the connecting rod. The drive assembly drives the locking assembly to lock or unlock the lower end of the connecting rod. The central locking structure of a folding tent as described in the present disclosure is simple in structure, easy to assemble and disassemble, saves time and labor, and has the desired connection effect.

2. In the present disclosure, during setup, the bottom end of the connecting rod is inserted into the locking chamber, and the locking teeth of the rollers are locked into the locking grooves of the connecting rod, thereby fixing the bottom end of the connecting rod in the unlocking chamber. During disassembly, the sliding sleeve is pushed downward along the second pole hub, such that the locking teeth of the rollers are locked into the locking grooves of the connecting rod. The connecting rod is pulled out, and the parts are folded for storage. The present disclosure features a simple structure, desired structural integrity, and no spare parts, such that the parts are not easily lost.

DETAILED DESCRIPTION OF THE EMBODIMENTS

Figure 1:
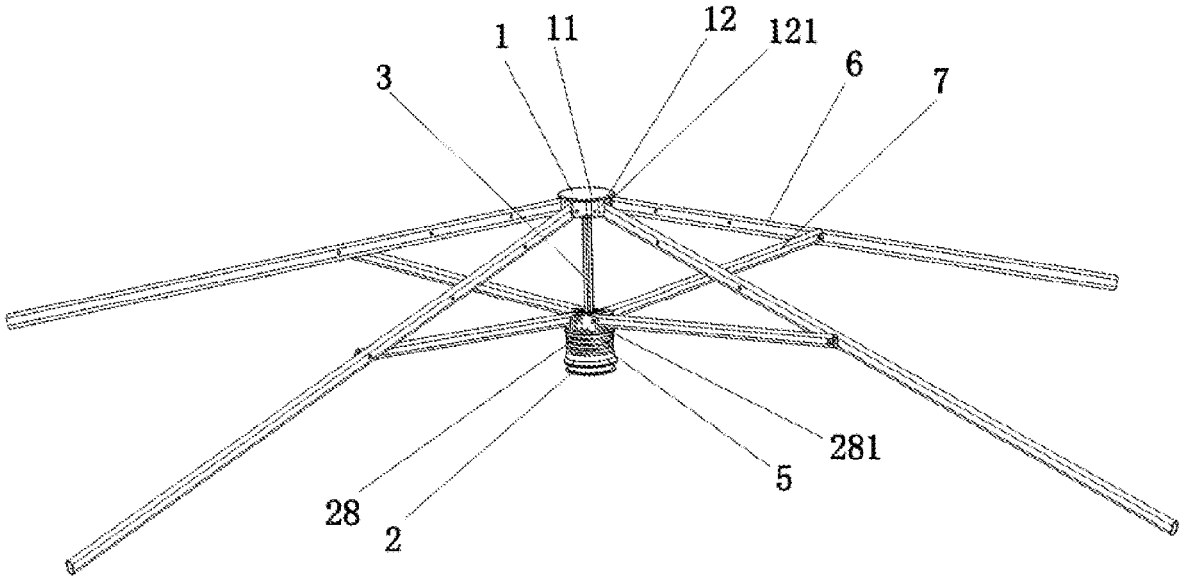
FIG. 1 is a structural view of a central locking structure of a folding tent according to the present disclosure.

To make the present disclosure's objectives, technical solutions, and advantages clearer, the present disclosure is described in further detail below with reference to the drawings and embodiments. It should be understood that the described specific embodiments are merely intended to explain the present disclosure, rather than to limit the present disclosure.

It should be understood that, in the description of the present disclosure, the terms such as "upper", "lower", "left", "right", "vertical", "horizontal", "inner", and "outer" are intended to indicate orientations shown in the drawings. It should be noted that these terms are merely intended to facilitate an understanding of and simplify the description of the present disclosure, rather than to indicate or imply that the mentioned apparatus or elements must have the specific orientation or be constructed and operated in the specific orientation. Therefore, these terms should not be construed as a limitation to the present disclosure.

EMBODIMENT

Figure 2:
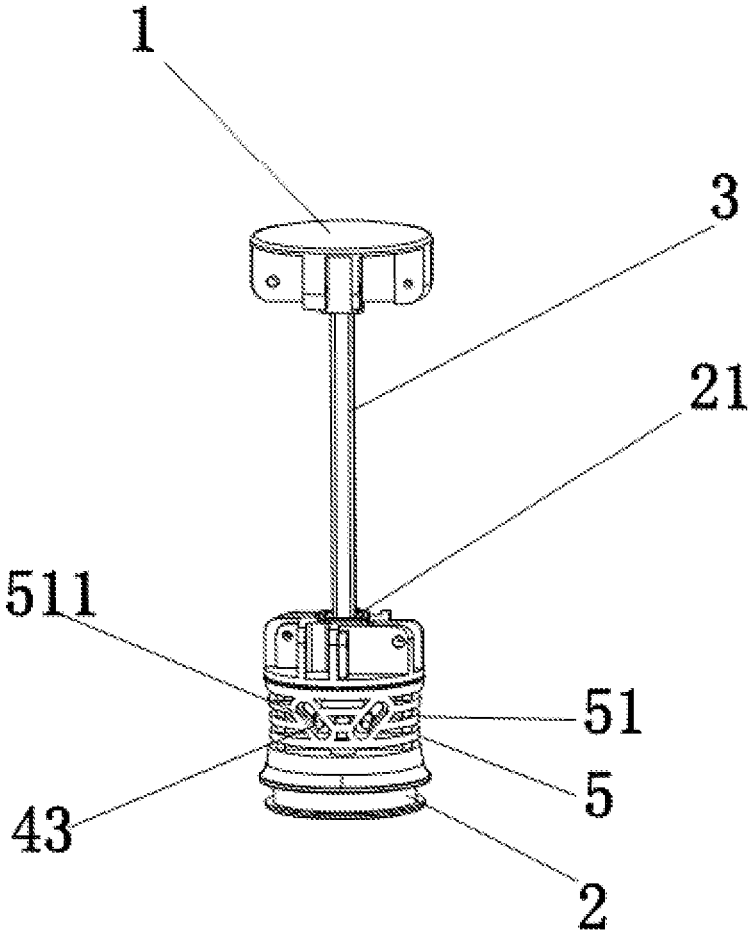
FIG. 2 is a structural view of the central locking structure without an upper pole and a lower pole according to the present disclosure.
Figure 3:
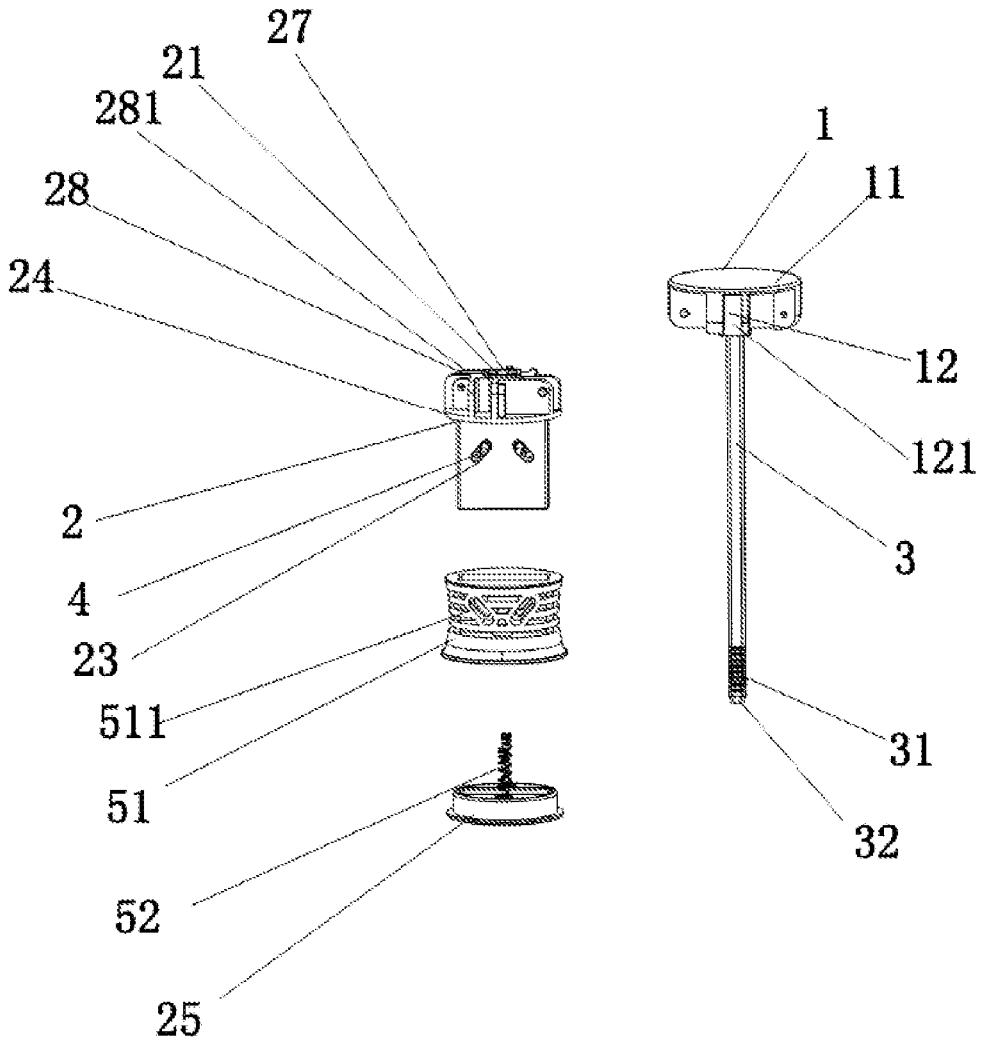
FIG. 3 is an exploded view of the structure shown in FIG. 2.
Figure 4:
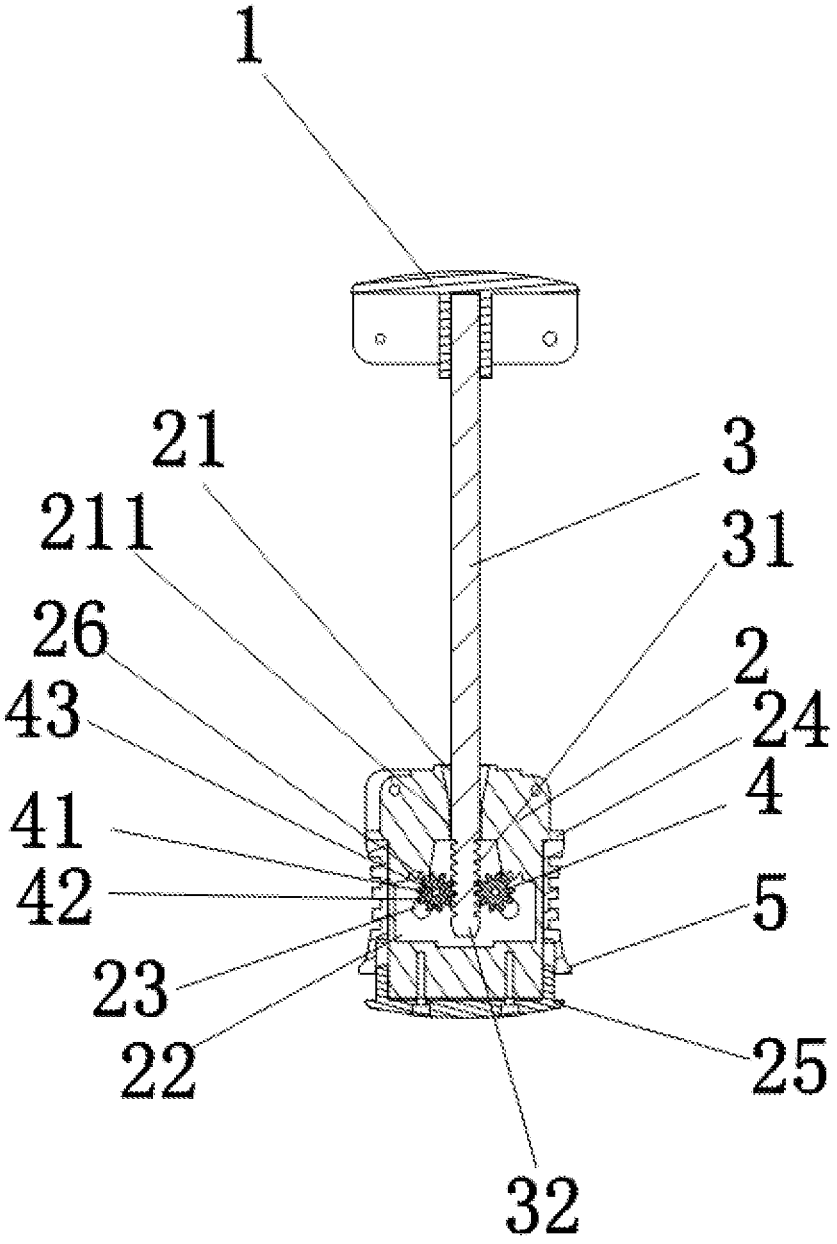
FIG. 4 is a sectional view of a connecting rod in a locked state according to the present disclosure.
Figure 5:
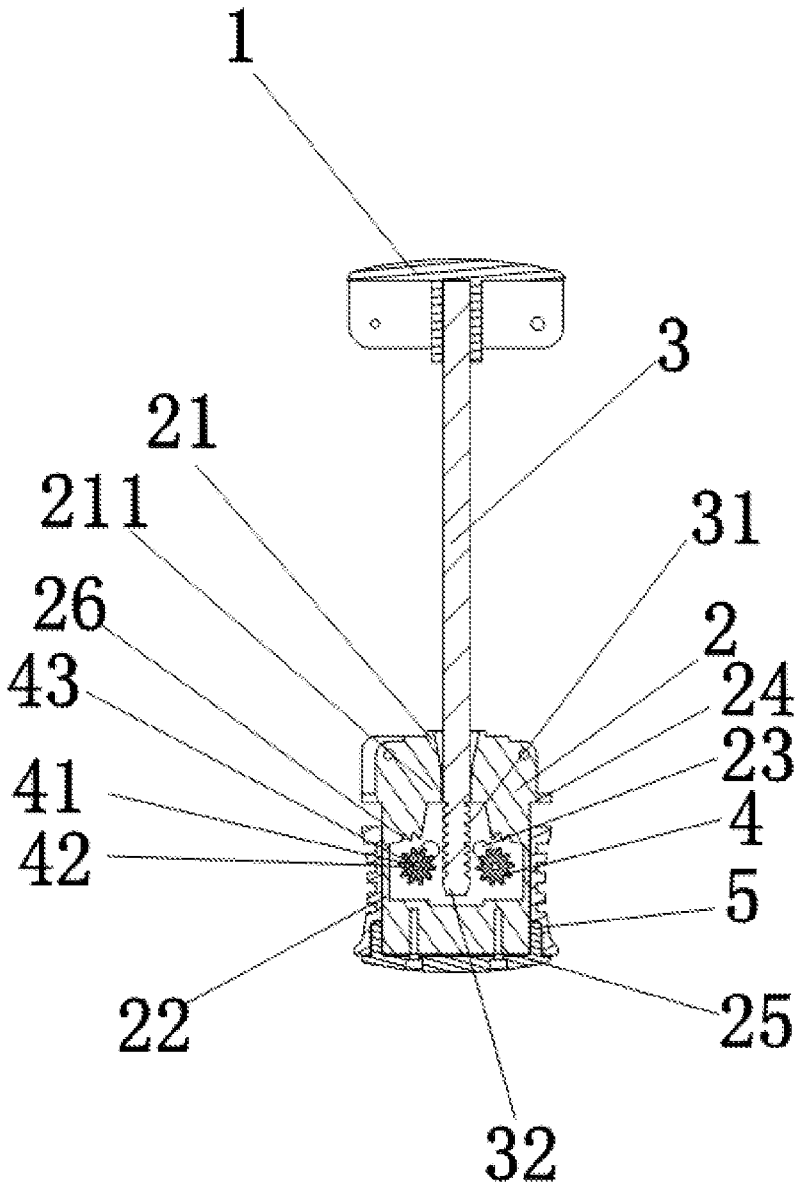
FIG. 5 is a sectional view of the connecting rod in an unlocked state according to the present disclosure.

As shown in FIGS. 1 to 5, the present disclosure provides a central locking structure of a folding tent. The central locking structure includes first pole hub 1, second pole hub 2, connecting rod 3, locking assembly 4, and drive assembly 5. The bottom of the first pole hub 1 is provided with the connecting rod 3, and the top of the second pole hub 2 is provided with insertion port 21 into which a lower end of the connecting rod 3 is inserted. The second pole hub 2 is provided with locking chamber 22 communicating with the insertion port 21. The locking assembly 4 is provided in the locking chamber 22 and is configured to fix the lower end of the connecting rod 3. The drive assembly 5 is configured to drive the locking assembly 4 to lock or unlock the lower end of the connecting rod 3.

The locking assembly 4 includes rollers 41 and a plurality of locking teeth 42 circumferentially arranged on an outer wall of each of the rollers 41. A side wall of the connecting rod 3 is axially provided with a plurality of locking grooves 31 which are matched with the locking teeth 42. Drive shaft 43 is provided on two sides of each of the rollers 41. An inner wall of the locking chamber 22 is provided with first oblong holes 23 for the drive shaft 43 to move. The drive assembly 5 drives the drive shaft 43 to move in the first oblong holes 23, such that the locking teeth 42 on the outer wall of each of the rollers 41 are locked into the locking grooves 31 or disengaged from the locking grooves 31.

The first oblong holes 23 are inclined toward the connecting rod 3. When the drive shaft 43 is located at the upper ends of the first oblong holes 23, the locking teeth 42 of each of the rollers 41 are locked into the locking grooves 31 of the connecting rod 3, and the connecting rod is in a locked state. When the drive shaft 43 moves downward gradually, the locking teeth 42 are gradually disengaged from the locking grooves 31, and the connecting rod is in an unlocked state.

The drive assembly 5 includes sliding sleeve 51 and spring member 52. The upper and lower ends of the second pole hub 2 are respectively provided with an upper limiting piece 24 and a lower limiting piece 25. The sliding sleeve 51 is slidably sleeved on an outer wall of the second pole hub 2 and is located between the upper limiting piece 24 and the lower limiting piece 25. The upper limiting piece 24 and the lower limiting piece 25 are configured to limit a sliding stroke of the sliding sleeve 51. The sliding sleeve 51 is elastically connected to the lower limiting piece 25 through the spring member 52. An outer wall of the sliding sleeve 51 is provided with second oblong holes 511. Ends of the drive shaft 43 are movably inserted into the second oblong holes 511 through the first oblong holes 23. The second oblong holes 511 are inclined in a direction that is opposite to the direction in which the first oblong holes 23 are inclined.

The two sets of first oblong holes 23 are splayed (e.g., spread apart), and the two sets of second oblong holes 511 are also splayed but invertedly as compared to the two sets of first oblong holes 23.

The upper limiting piece 24 is fixedly provided on the top end of the second pole hub 2, and the lower limiting piece 25 is detachably provided on the bottom end of the second pole hub 2 through a bolt. The top end of the connecting rod 3 is detachably provided on the bottom end of the first pole hub 1 through a bolt.

The bottom end of the sliding sleeve 51 and the top end of the lower limiting piece 25 are respectively provided with an upper mounting groove and a lower mounting groove. The upper and lower ends of the spring member 52 are respectively inserted into the upper mounting groove and the lower mounting groove. The inner diameters of the upper mounting groove and the lower mounting groove are adapted to correspond to an outer diameter of a spring of the spring member 52 to prevent the spring member 52 from being offset and inclined from left to right.

Limiting grooves 26 are provided in the locking chamber 22 and located above the first oblong holes 23. The limiting grooves 26 are configured to limit the left and right positions of the locking assembly 4 in cooperation with the locking grooves 31 when the locking teeth 42 are locked into the locking grooves 31 to prevent each of the rollers 41 from shaking left and right when the connecting rod is in the locked state.

In this embodiment, there are two rollers 41 provided on two sides of the connecting rod 3 respectively. The connecting rod 3 and the drive assembly 5 are adapted to cooperate with the two rollers 41. The two rollers 41 cooperate to fix the two sides of the connecting rod 3 with the desired locking effect and position the two sides of the connecting rod 3 to prevent the connecting rod 3 from tilting left and right.

The inner diameter of the insertion port 21 is larger than the outer diameter of the connecting rod 3, which facilitates the insertion of the bottom end of the connecting rod 3. A lower end of the insertion port 21 extends inward to form limiting port 211. The inner diameter of the limiting port 211 is adapted to correspond to the outer diameter of the connecting rod 3 to position a peripheral side of the connecting rod 3, such that the connecting rod 3 is in a vertical state without being inclined.

The bottom end of the connecting rod 3 extends inward to form push head 32. The push head 32 has a trapezoidal cross-section. When the bottom end of the connecting rod 32 is inserted into the locking chamber, due to the small width of the front end of the push head 32, the front end of the push head 32 is clamped between the two rollers 41. Trapezoidal oblique sides of the push head 32 push the rollers 41 to move downward along the first oblong holes 23, such that the bottom end of the connecting rod 3 is inserted between the two rollers 41.

The first pole hub 1 includes first pole hub body 11 and a plurality of first hinge bases 12 that are circumferentially arranged on the bottom of the first pole hub body 11. Each of the plurality of first hinge bases 12 is hinged to an upper pole 6. The second pole hub 2 includes second pole hub body 27 and a plurality of second hinge bases 28 that are circumferentially arranged on the top of the second pole hub body 27 and correspond to the first hinge bases 12. Each of the second hinge bases 28 is hinged to one end of a lower pole 7, and the other end of the lower pole 7 is rotatably connected to the upper pole 6. The first hinge bases 12 each are provided with a first hinge port 121, and the second hinge bases 28 each are provided with a second hinge port 281. The first hinge port 121 and the second hinge port 281 are L-shaped ports with opposite opening directions.

During setup, the bottom end of the connecting rod 3 is inserted into the locking chamber 42 through the insertion port 41. The push head 32 at the bottom end of the connecting rod 3 pushes the rollers 41 to move downward along the first oblong holes 23, such that the bottom end of the connecting rod 3 is inserted between the two rollers 41. The spring extension of the spring member 52 automatically drives the sliding sleeve 51 to move upward along the second pole hub 2. The ends of the drive shaft 43 are movably inserted into the second oblong holes 511 through the first oblong holes 23, and the second oblong holes 511 and the first oblong holes 23 are inclined in opposite directions. Thus, when the sliding sleeve 51 moves upward, the second oblong holes 511 drive the drive shaft 43 to move upward in the first oblong holes 23, such that the locking teeth 42 on the outer wall of the rollers 41 are locked into the locking grooves 31 of the connecting rod 3. At this time, the upper limiting piece 24 on the upper end of the second pole hub 2 determines the end point of the upward movement of the sliding sleeve 51 to prevent the sliding sleeve 51 from continuing to move upward. The spring extension of the spring member 52 supports the sliding sleeve 51 to maintain this state, thereby realizing the locked state of the connecting rod 3 by the locking assembly 4.

During unlocking, the sliding sleeve 51 is manually driven to move downward along the second pole hub 2. When the sliding sleeve 51 moves upward, the second oblong holes 511 drive the drive shaft 43 to move downward in the first oblong holes 23, such that the locking teeth 42 on the outer wall of the rollers 41 are disengaged from the locking grooves 31 of the connecting rod 3. The connecting rod 3 is pulled out from the locking chamber 42, and the upper pole 6 and the lower pole 7 are rotated and folded for storage.

The above described are merely specific implementations of the present disclosure, and the protection scope of the present disclosure is not limited thereto. Any modification or replacement easily conceived by those skilled in the art within the technical scope of the present disclosure should fall within the protection scope of the present disclosure. Therefore, the protection scope of the present disclosure should be subject to the protection scope of the claims.

What is claimed is:

1. A central locking structure of a folding tent, comprising a first pole hub, a second pole hub, a connecting rod, a locking assembly, and a drive assembly, wherein a bottom of the first pole hub is provided with the connecting rod, and a top of the second pole hub is provided with an insertion port; a lower end of the connecting rod is inserted in to the insertion port; the second pole hub is provided with a locking chamber communicating with the insertion port; the locking assembly is provided in the locking chamber, and is configured to fix the lower end of the connecting rod; and the drive assembly is configured to drive the locking assembly to lock or unlock the lower end of the connecting rod, wherein the locking assembly comprises rollers and locking teeth circumferentially arranged on an outer wall of each of the rollers; a side wall of the connecting rod is axially provided with locking grooves, the locking grooves are matched with the locking teeth; a drive shaft is provided on two sides of each of the rollers; an inner wall of the locking chamber is provided with first oblong holes for the drive shaft to move; and when the drive assembly drives the drive shaft to move in the first oblong holes, the locking teeth on the outer wall of each of the rollers are locked into or disengaged from the locking grooves.

2. The central locking structure according to claim 1, wherein the first oblong holes are inclined toward the connecting rod.

3. The central locking structure according to claim 2, wherein the drive assembly comprises a sliding sleeve and a spring member; upper and lower ends of the second pole hub are respectively provided with an upper limiting piece and a lower limiting piece; the sliding sleeve is slidably sleeved on an outer wall of the second pole hub and is located between the upper limiting piece and the lower limiting piece; the sliding sleeve is elastically connected to the lower limiting piece through the spring member; an outer wall of the sliding sleeve is provided with second oblong holes; ends of the drive shaft are movably inserted into the second oblong holes through the first oblong holes; and the second oblong holes are inclined in a direction opposite to an inclined direction of the first oblong holes.

4. The central locking structure according to claim 3, wherein a bottom end of the sliding sleeve and a top end of the lower limiting piece are respectively provided with an upper mounting groove and a lower mounting groove; upper and lower ends of the spring member are respectively inserted into the upper mounting groove and the lower mounting groove; and inner diameters of the upper mounting groove and the lower mounting groove are adapted to an outer diameter of a spring of the spring member.

5. The central locking structure according to claim 1, wherein limiting grooves are provided in the locking chamber and located above the first oblong holes; and the limiting grooves are configured to limit left and right positions of the locking assembly in cooperation with the locking grooves when the locking teeth are locked into the locking grooves.

6. The central locking structure according to claim 1, wherein a bottom end of the connecting rod extends inward to form a push head.

7. The central locking structure according to claim 1, wherein there are two rollers provided on two sides of the connecting rod respectively.

8. The central locking structure according to claim 1, wherein an inner diameter of the insertion port is larger than an outer diameter of the connecting rod; a lower end of the insertion port extends inward to form a limiting port; and an inner diameter of the limiting port is adapted to the outer diameter of the connecting rod.

9. The central locking structure according to claim 1, wherein the first pole hub comprises a first pole hub body, and first hinge bases; the first hinge bases are circumferentially arranged on a bottom of the first pole hub body and are each hinged to an upper pole; the second pole hub comprises a second pole hub body, and second hinge bases; the second hinge bases are circumferentially arranged on a top of the second pole hub body and correspond to the first hinge bases; and the second hinge bases are each hinged to a first end of a lower pole, a second end of the a lower pole is rotatably connected to the upper pole.

* * * * *